US009718574B2

(12) United States Patent
Sireix

(10) Patent No.: US 9,718,574 B2
(45) Date of Patent: Aug. 1, 2017

(54) METHOD FOR MANUFACTURING A COVERING STRUCTURE FOR A TUBULAR PACKAGE AND SAID PACKAGE, COVERING STRUCTURE AND PACKAGE

(71) Applicant: Georges Sireix, Riedisheim (FR)

(72) Inventor: Georges Sireix, Riedisheim (FR)

( * ) Notice: Subject to any disclaimer, the term of this patent is extended or adjusted under 35 U.S.C. 154(b) by 750 days.

(21) Appl. No.: 13/759,715

(22) Filed: Feb. 5, 2013

(65) Prior Publication Data

US 2013/0200138 A1 Aug. 8, 2013

(30) Foreign Application Priority Data

Feb. 6, 2012 (FR) ..... 12 51086

(51) Int. Cl.
*B65D 3/26* (2006.01)
*B31C 99/00* (2009.01)
(Continued)

(52) U.S. Cl.
CPC ..... *B65D 3/268* (2013.01); *B31C 13/00* (2013.01); *B31D 1/005* (2013.01); *B31D 1/0068* (2013.01);
(Continued)

(58) Field of Classification Search
CPC .... B65D 2251/0093; B65D 2577/2041; B65D 3/04; B65D 3/268; B65D 2251/0021; B65D 2251/0018; B65D 21/0217; B65D 3/28; B65D 51/20; B65D 77/2096; B31D 1/0075; B31D 1/005; B31B 2217/06; B31B 2217/108; B31B 2217/064; B31C 13/00; Y10T 428/24215; Y10T 156/1051
(Continued)

(56) References Cited

U.S. PATENT DOCUMENTS 2,310,398 A * 2/1943 Cole ..... B65D 3/268 215/305
4,556,152 A 12/1985 Bogren
(Continued)

FOREIGN PATENT DOCUMENTS

FR 2 716 408 A 8/1995

OTHER PUBLICATIONS

Search Report issued by French Patent Office for priority application FR1251086 dated Nov. 22, 2012.

*Primary Examiner* — Robert Long
*Assistant Examiner* — Xavier A Madison
(74) *Attorney, Agent, or Firm* — Haug Partners LLP

(57) ABSTRACT

The invention relates to a method for manufacturing a covering structure for a cardboard package comprising a tubular body made up a cardboard material. The covering structure comprises a flat assembly of three materials: (1) a cellulosic material covered with a reactivatable barrier material over the face thereof oriented towards a safety membrane, making up a lid cardboard, (2) a laminating part arranged between said lid cardboard and the safety membrane, with a shape conjugated to the shape of the opening of the tubular body, made from paper, or paper whereof the face oriented towards said lid cardboard is coated with a material having barrier and sealing properties, and (3) a safety membrane, made up of a paper coated with at least one reactivatable barrier material on the surface thereof not oriented towards the laminating part.

17 Claims, 5 Drawing Sheets

(51) Int. Cl.

| | |
|---|---|
| ***B65D 3/28*** | (2006.01) |
| ***B31D 1/00*** | (2017.01) |
| ***B65D 21/02*** | (2006.01) |
| ***B65D 77/20*** | (2006.01) |
| ***B65D 51/20*** | (2006.01) |
| ***B65D 3/04*** | (2006.01) |

(52) U.S. Cl.
CPC ..... *B31D 1/0075* (2013.01); *B65D 3/04* (2013.01); *B65D 3/28* (2013.01); *B65D 21/0217* (2013.01); *B65D 51/20* (2013.01); *B65D 77/2096* (2013.01); *B31B 2217/064* (2013.01); *B31B 2217/082* (2013.01); *B31B 2217/108* (2013.01); *B65D 2251/0018* (2013.01); *B65D 2251/0093* (2013.01); *B65D 2577/2041* (2013.01); *Y10T 156/1051* (2015.01); *Y10T 428/24215* (2015.01)

(58) Field of Classification Search
USPC ..... 220/276, 359.3; 229/5.5; 493/102
See application file for complete search history.

(56) References Cited

U.S. PATENT DOCUMENTS

| | | | | |
|---|---|---|---|---|
| 4,636,273 | A * | 1/1987 | Wolfersperger ..... | B65D 77/206 156/244.11 |
| 5,566,529 | A * | 10/1996 | Sireix ..... | 53/412 |
| 6,047,878 | A | 4/2000 | Lowry | |
| 6,302,321 | B1 * | 10/2001 | Reese ..... | B29C 65/18 156/69 |
| 2008/0110896 | A1 * | 5/2008 | Westphal ..... | 220/359.2 |
| 2008/0169286 | A1 * | 7/2008 | McLean ..... | B32B 37/1284 220/257.2 |

* cited by examiner 1
2
3
3a
3b
4
5
6
6a
6b
7
8
8a
8b
8c
9
10
11
12
13
14
15
16
A
A1+A2
B
B1
C
C1
D 3a+3b
6a+6b
8a1+8b1+8c
16

E
53
51
16
52
55
54

51
52
55
54
56

F
57
58

G
62

62

60
59

56

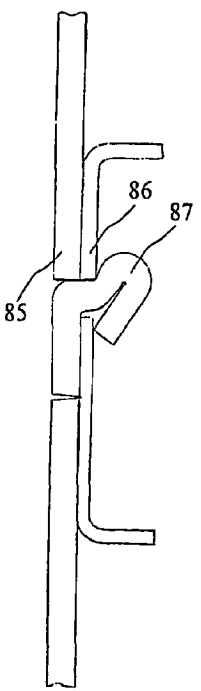
Fig.9
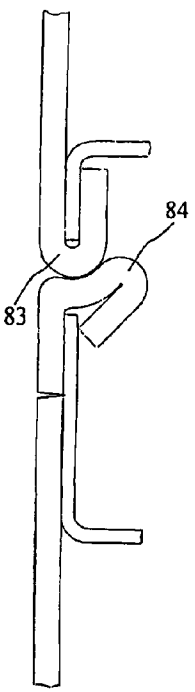
Fig.8
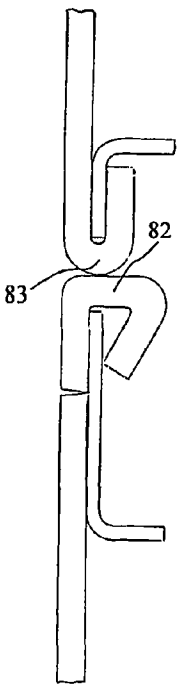
Fig.7
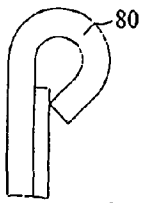
Fig.6a
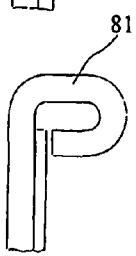
Fig.6b
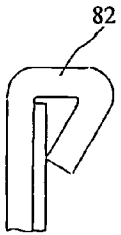
Fig.6c
Fig.5
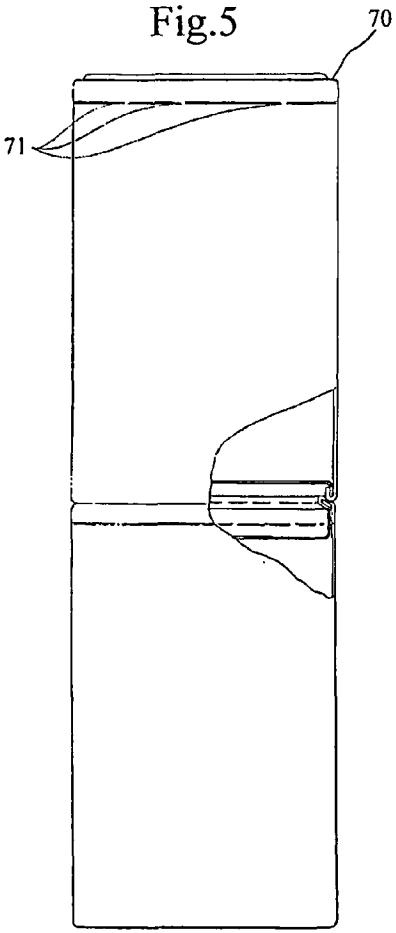

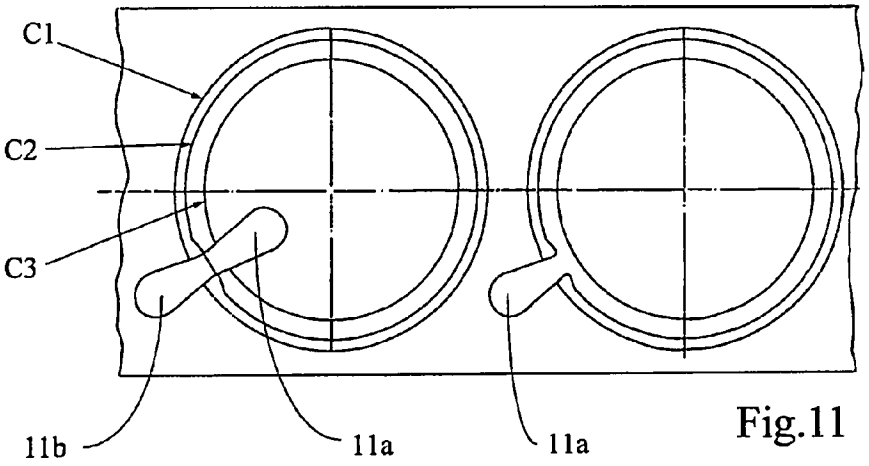
Fig.11
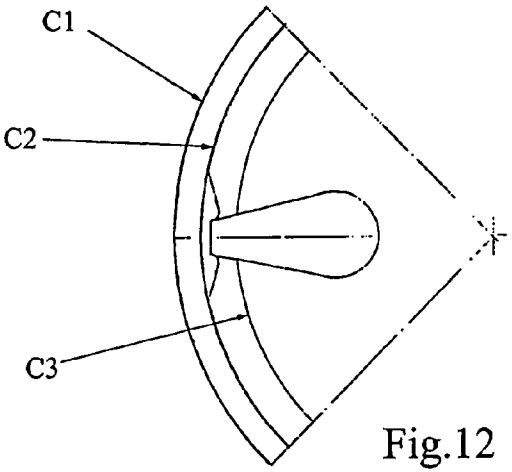
Fig.12
Fig.10
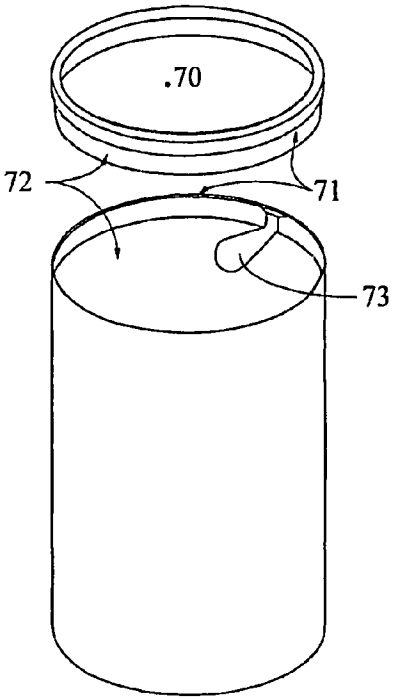

METHOD FOR MANUFACTURING A COVERING STRUCTURE FOR A TUBULAR PACKAGE AND SAID PACKAGE, COVERING STRUCTURE AND PACKAGE

This application claims priority benefits to French Patent Application No. 1251086 filed Feb. 6, 2012, the entire disclosure of which is incorporate herein by reference.

FIELD OF THE INVENTION

The present invention relates to the field of tubular cardboard packages, comprising a rigid tubular body made from a cardboard material, a bottom and a cover sealably assembled to the tubular body, designed to contain solid products in divided forms, such as powders, grains, granulates or fibers.

The tubular elements in question are both tubular packages with a round section and tubular packages with a non-round section, for example such as rectangular packages. The invention also relates to the field of tubular cardboard packages designed for liquid or pasty products.

The invention more particularly relates to a method for manufacturing a covering structure for a cardboard package comprising a tubular body made up of one or more layers of a cardboard material and a lid sealably assembled to the tubular body, said covering structure comprising a lid cardboard and a safety membrane. This type of packaging is designed to receive a bottom at a later time, after being filled with the product it is designed to contain.

BACKGROUND OF THE INVENTION

The term "cardboard packaging" usually refers to packaging whereof at least 90 to 98 wt % consists of cellulosic materials. In addition to the layers of cellulosic materials, this type of packaging comprises metal layers or coatings, such as aluminum, or synthetic layers or coatings, associated with the cellulosic materials to form a composite surface material. According to the generally accepted vocabulary, these metal or synthetic coatings make up a "barrier material" isolating the product stored inside the package from the outside environment, for example to prevent oxidation or drying out, or to provide protection from chemical or biological pollutants. The synthetic layers/coatings may also play an essential role in the sealing between two parts of the packaging during the manufacture thereof; in that case, they are generally described as "reactivatable barrier material."

French patent no. 94 02003, published under no. FR 2 716 408, describes the manufacture of a tubular package of the type described above. The covering structure is formed by a lid cardboard made from a cellulosic material and a safety membrane made from a cellulosic material covered with a barrier material. These two pieces are formed one after the other, in the form of cylindrical basins using a shaping punch through an outer die and engaged in one end of the tubular body. The lateral walls of the two pieces are sealably assembled with the inner wall of the tubular body. The wall of the tubular body is then cut out along a peripheral line situated between the assembly areas of the two pieces, so as to allow the lid cardboard to be opened without tearing the safety membrane.

The drawback of this package is that with wear, after the lid has been opened and the safety membrane has been removed so as to be able to remove a first quantity of the contents, the lid cardboard without protection no long provides enough sealing for the box to maintain the freshness of the unused product for several days or weeks.

OBJECT AND SUMMARY OF THE INVENTION

The first aim of the present invention is to offset this problem. The invention also aims to simplify the shaping, placement and sealing tool of the covering structure.

Lastly, the invention proposes to:

- facilitate the separation of the safety membrane upon the first use while decreasing the necessary tractive force, without, however, altering the sealing of the membrane before the first use;
- produce a lid profile capable of allowing stacking, i.e., a stack of stored boxes.

To that end, the invention relates to a method for manufacturing a covering structure for a cardboard package comprising a tubular body made up of one or more layers of a cardboard material and a lid sealably assembled to the tubular body, said covering structure comprising a lid cardboard and a safety membrane, said method comprising the flat assembly of three materials in sheets or strips, i.e.:

- a cellulosic material covered with at least one reactivatable barrier material over the face thereof oriented towards said safety membrane, making up said lid cardboard,
- a laminating part arranged between said lid cardboard and the safety membrane, with a shape conjugated to the shape of the opening of the tubular body, made from paper, or paper whereof the face oriented towards said lid cardboard is coated with a material having barrier and sealing properties relative to said lid cardboard, and
- a material forming said safety membrane, made up of a paper coated with at least one reactivatable barrier material on the surface thereof not oriented towards a laminating part.

According to one embodiment, the laminating part is sealed on said lid cardboard over the entire surface thereof, with the exception of the marginal area extending over the entire circumference of said laminating part.

According to one embodiment, the material making up said safety membrane undergoes pre-cutting generating a tongue, said tongue is folded down on the safety membrane across from the laminating part before being assembled with the other materials, and the material forming the safety membrane is partially sealed on the marginal area of the lid cardboard situated between the edge of the laminating part and the edge of said covering structure.

According to one embodiment, the reactivatable barrier material of the lid cardboard is replaced by a cold or hot glue, the laminating part is completely glued by said cold or hot glue, and the perimeter of the membrane is glued on the lid cardboard by cold or hot gluing with the exception of the sector where the opening tongue is positioned, to allow discharged air to pass.

According to one embodiment, the assembly formed by the three assembled materials undergoes cutting producing said covering structure in the form of a flat portion comprising a central part with a shape conjugated with the shape of the opening of the tubular body, surrounded by a peripheral portion that can be folded down that is sufficient to sealably assemble the covering structure with the inner lateral wall of the tubular body.

According to one preferred embodiment leading to the formation of a strip bearing covering structures, the method is continuous and paced step by step; the three materials making up the assembly are strips of materials; the strip intended to make up said laminating parts periodically comes across from the strip intended to make up said lid cardboard and undergoes cutting forming a laminating part each time, which is sealed or glued on the strip intended to make up said lid cardboards; and the strip intended to form the safety membrane undergoes said precutting and folding down operations of the tongue according to the pacing of the method, then is assembled strip by strip with the strip designed to form the lid cardboards, while being partially sealed or glued only on the lid cardboard surface portions situated between the laminating parts and the perimeters of said covering structures.

According to one embodiment, the strip intended to form the laminating parts crosses the strip intended to form said lid cardboards at the cutting and placement tool; said tool cuts a laminating part in the shape of the opening of the tubular body upon each step, then presses said laminating part against the strip designed to form said lid cardboards while heating the contact area to reactivate the barrier materials therein and perform pre-sealing; and a sealing tool, arranged downstream of said cutting and placement tool, finishes completely sealing the laminating part with the exception of the marginal area extending over the entire circumference of the laminating part. In the case where the laminating part is glued, the sequence of steps of the method is the same.

According to one embodiment, the strip designed to form the safety membrane successively passes through a tongue cutting tool, a tool lifting and folding down said tongues, and a hammer performing the final folding of the tongues oriented toward the center of the flat portions.

The strip obtained by assembling the three materials in a strip can be cut according to the third described mentioned above into individual flat portions forming the covering structures.

The invention also relates to a method for manufacturing a cardboard package comprising a tubular body made from one or more layers of a cardboard material and a lid sealably assembled to the tubular body, this method comprising:

- producing a covering structure as described above,
- introducing said covering structure into a forming, placement and sealing tool, heating said covering structure and shaping it in the form of a basin, introducing and sealing the basin in the tubular body using the forming, placement and sealing tool,
- precutting the lateral wall of the tubular body and the membrane along a peripheral line situated above said tongue.

According to one embodiment of the method for manufacturing a cardboard package defined above, the end of the tubular body that receives said covering structure undergoes finishing comprising:

- folding down over its entire circumference using a hemming tool forming a first hem,
- using vertical and lateral pressure to convert said first hem into a flat profile hem,
- creating a female stacking profile in said flat profiled hem using a roller tool chosen according to the male stacking profile of the box bottom designed to be stacked on said cardboard package.

The invention also relates to a support strip for the covering structures that is obtained using a method as defined above.

The invention relates to a covering structure in the form of a flat portion obtained using a method as defined above.

According to one embodiment, the covering structure comprises a tongue that has a distal end wide enough to ensure easy gripping by a consumer, a narrow portion, forming a connecting neck, near its proximal end of the sealed portion of said safety membrane, and a rounded portion between the neck and the sealed portion of the safety membrane.

According to one particular embodiment, said distal end has a substantially circular shape whereof the diameter is comprised between 10 and 14 mm, the length of the tongue is comprised between 22 and 30 mm, and the width of the connecting neck is comprised between 4 and 6 mm.

The invention also relates to a cardboard package obtained using a manufacturing method as defined above. According to one particular embodiment of the package, it comprises a covering structure with a tongue as defined above.

BRIEF DESCRIPTION OF THE DRAWINGS

Other features and advantages of the invention will appear to those skilled in the art from the description provided below of one preferred embodiment, in reference to the drawings, in which:

FIG. 5 is an elevation and partial cross-sectional view of two tubular boxes, superimposed and stacked, FIGS. 6*a*, 6*b* and 6*c* illustrate a hemming and pre-stacking process for one lid edge of a tubular package, FIGS. 7, 8 and 9 illustrate three alternatives of the profile of a tubular package lid edge having undergone a stacking operation, FIG. 10 shows a tubular package according to the invention whereof the lid has been removed, but the safety membrane of which is intact, FIG. 11 illustrates the position of the cutout of the tongue relative to the geometric characteristics of the covering structure and the tubular package, FIG. 12 shows an enlarged view of the tongue in a position folded at 180° on the membrane.

DETAILED DESCRIPTION OF PREFERED EMBODIMENTS OF THE INVENTION

One embodiment of a continuous and paced method for manufacturing covering structures according to the invention, the steps of which are described below, is diagrammatically illustrated in its entirety by FIG. 1.

A. Starting Materials

A cardboard strip (1) of the "lid cardboard" type, which may or may not be printed, is unwound from a spool precisely and pitch by pitch by a feed band (2) controlled by a servomotor. The advance pitch is controlled by reading a cell on a spot or by an encoder placed on the band if there is no spot.

Figures 1, 1A, 1B, 1C:
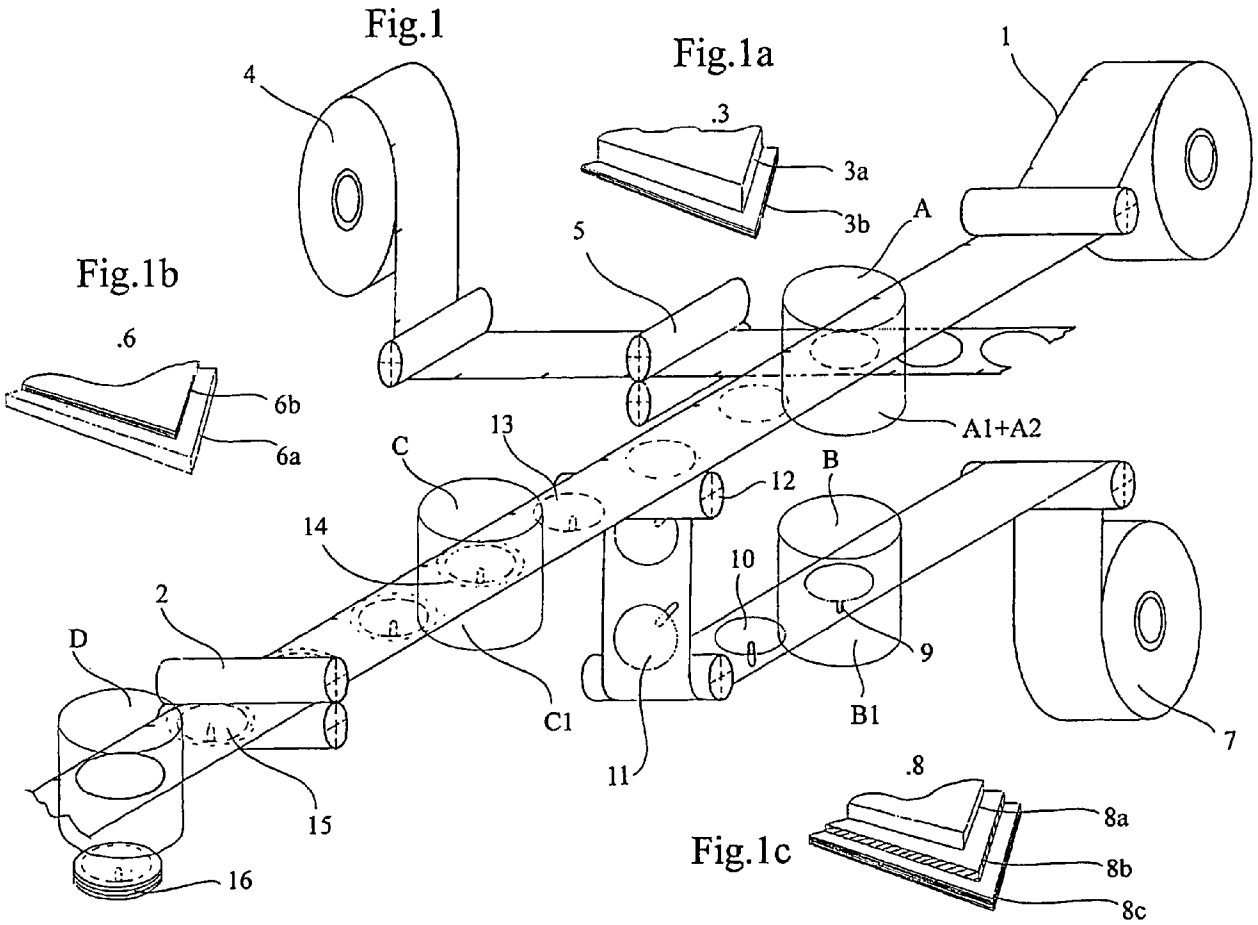
FIG. 1 is a block diagram showing the manufacture of covering structures using a continuous and paced method.
FIGS. 1*a*, 1*b* and 1*c* illustrate the structure of the three strips of materials used in the context of the above method, the left part of FIG. 2 shows an axial cross-section and the right part of FIG. 2 shows an exploded axial half-section of the covering structure according to the invention.

The composition of the lid cardboards (3) is illustrated by FIG. 1*a*: cardboard with a thickness of 250 to 500 microns (3*a*) covered with a reactivatable barrier material (3*b*).

A second strip (4) of laminating material (6), which may or may not be printed, is also unwound precisely and pitch by pitch by a feed band (5) controlled by a servomotor. The advancement pitch is controlled by reading a cell on a spot or by an encoder placed on the strip if there is no spot.

This strip, the composition of which is illustrated by FIG. 1*b*, is made up of paper (6*a*) or, in the present embodiment, of paper (6*a*) provided with a barrier material (6*b*) having sealing properties on the barrier material of the lid cardboard (3*b*).

The role of the paper is fundamental in the method for the following reason: it prevents sealing between the lid cardboard covered with the barrier material and the safety membrane, which in turn is made from paper and, among other components, coating(s) of sealable barrier material(s), because such sealing would prevent the lid from being opened without breaking the safety membrane.

A third strip (7) for the safety membrane is unwound from a spool and driven simultaneously with the strip 1 by the feed band (2) of the "lid cardboard."

The composition of the safety membrane (8) is illustrated by FIG. 1*c*: a paper (8*a*)+a barrier material (8*b*)+a reactivatable barrier material (8*c*). To ensure easy opening of the safety membrane the first time the product is used, this material has a sealability and peelability property.

As will be described below, with these three strips, three flat materials are assembled; the latter will be cut out in the form of the final box, but with a larger size to allow stamping of a basin whereof the edges will be sealed or glued in the box body.

B. Processing and Placement of the Laminating Parts

The strip of lid cardboard (1) from the spool is driven pitch by pitch by the feed band (2) controlled by a servomotor and passes through the upper stage A2 of a tool for placing the laminate A. The laminating strip (4) driven pitch by pitch by the feed band (5) controlled by a servomotor passes through the same tool (A) at the lower stage A1 and crosses the lid cardboard at a right angle.

A punch+die assembly in A1 cuts a piece in the laminating material in the shape of the final box, smaller than the lid, that piece being pre-sealed by a heated buffer to reactivate the sealing layer placed on the lower portion of the lid cardboard and that on the upper portion of the laminating material.

The lid cardboard provided with the laminating part advances by several pitches toward a tool for sealing the laminate (not shown in FIG. 1). The purpose of this tool is to seal the laminating part completely to ensure complete cohesion between the lid and the laminate. However, care is taken not to seal the laminating part over several millimeters and over the entire circumference, so that no tension is exerted on the materials during the subsequent forming operation by 90° curvature and sealing in the box body, with the aim of avoiding the presence of air between the two materials.

C. Processing and Placement of the Safety Membrane

According to another embodiment, the aforementioned sealing layer may be replaced by gluing.

The strip (7) of membrane material (8) is driven by the feed band (2) of the lid cardboard, pitch by pitch and precisely. Assembling the safety membrane on the lid cardboard requires several preparation and placement operations. All of these operations are carried out on the strip itself according to the following sequences:

C1. Processing of the Opening Tongue of the Safety Membrane

The strip (7) coming from the spool passes through a pre-cutting tool (B). A punch+die assembly (B1) of suitable shape precuts the tongue (9) from the complex material (8) along a specific cutting line that will be described later.

One pitch further downstream, the tongue is lifted by 90°, then folded down at 180° during the next advancement, as diagrammatically illustrated by the reference (10) in FIG. 1 (the corresponding tool, known in itself, is not shown in FIG. 1 for clarity reasons).

One pitch further downstream, a hammer (not shown in FIG. 1), in point 11, performs the final precise folding at 180°. The tongue is thus turned back toward the center of the future lid, its proximal end being placed very slightly behind the future cutout.

At the exit from the 90° return roll (12), the lid cardboard strip provided with laminating parts and the membrane strip provided with opening tongues are driven and synchronized, but still remain free relative to one another in the position (13).

C2. Pre-Sealing of the Membrane

Several pitches further downstream, at 14, the membrane strip with its folded down tongues is partially sealed, or glued according to one alternative, in the sealing tool (C) by a heated buffer with a special shape (C1), i.e., at several points distributed over the surface portion of the lid cardboard situated between the laminating part and the perimeter of the future cutout. The partial sealing is necessary so that during the subsequent shaping by 90° curvature, the laminating materials and membrane slide relative to one another to eliminate any folds as well as the presence of any air between the layers.

D. Final Assembly and Cutout of the Covering Structure

At the outlet of the feed band (2), the three materials:

lid cardboard, laminating part, safety membrane, are assembled precisely, as illustrated in (15) in FIG. 1, relative to a printing, a mark or a pitch that is constant over the lid cardboard strip.

At this stage, there are two possibilities:

1) The strip made up of the three materials is wound and stored for later use (option not shown in FIG. 1);

2) In the strip made up of the three materials, a punch+die (D) cuts out flat portions making up covering structures (16), which can be used immediately by the machine performing the placement and sealing of the lid in the tubular body, or stored in a stack for later use.

Figures 2, 3A, 3B, 3C, 3D:
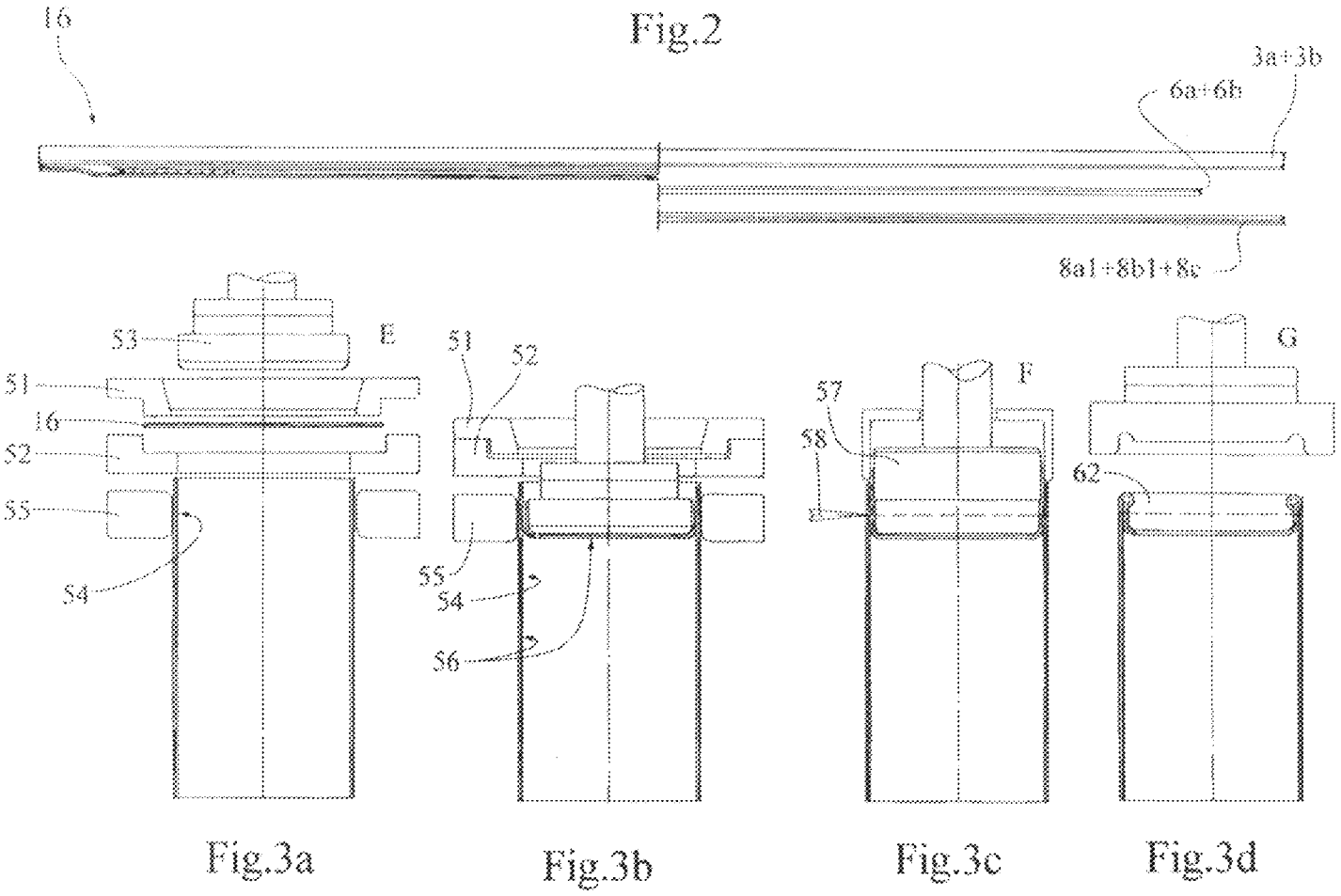
FIGS. 3*a*, 3*b*, 3*c* and 3*d* show an axial cross-sectional view of four phases of the assembly of a covering structure according to FIG. 2 with a tubular package body.

The left part of FIG. 2 shows an axial half-section of a covering structure (16), and the right part of that figure shows an exploded half-section of that same covering structure.

E. Placement, Sealing, Pre-Cutting of the Lid and the Membrane in the Box Body

FIGS. 3*a*, 3*b*, 3*c* and 3*d* show an axial cross-section of four phases of the assembly of a covering structure (16) according to FIG. 2 with a tubular package body, the assembly between the edge of the covering structure and the edge of the tubular body being illustrated by the enlarged view 4A-4D.

The flat cutout (16) made up of the "lid cardboard," the laminate and the membrane is introduced into the forming, placement and sealing tool (E).

A blank holder (51) keeps the cutout (16) on the die (52), and a buffer (53) heated by high-frequency ultrasound or conduction and provided with a protector stamps the cutout (16), forms it in the shape of a basin and places it simultaneously in the box body (54).

A counter-sealing die (55) provides the outside-in pressure needed for complete sealing of the material of the safety membrane against the box body, the latter being covered with a sealing material (56) which in turn is compatible with the material of the membrane.

E1. Precutting the Lid

It can be made as described in French patent no. 94 02003. The tubular box body +covering structure assembly is introduced into a precutting tool (F) and is placed on a precutting module (57) comprising a set of rotary or static blades (58). The tool (F) may be provided with fine notches to process three to four "tamper-evident" points. This operation cuts the following layers:

- the box body, which is therefore separated into a ring (59);
- the safety membrane (8), from which a ring (60) is separated;
- the perimeter of the laminating part, at approximately 50% of the thickness thereof.

The lid made up of the ring (59) and the lid cardboard to which the majority of the laminating part remains fixed is thus separated from the three layers above. It should be noted that the opening tongue is placed just below the precut.

E2. Opening the Lid

Through simple pulling, the consumer will open the lid (70) by breaking the three or four tamper-evident points (71). The latter are indicated by a sign printed on the box. For a rectangular box, for example, the three tamper-evident points are generally on one of the two large surfaces, the opposite surface being provided with a hinge, and in that case the lid pivots. For a round box, opening is possible over the entire circumference.

It should be noted that the lid (70) can be opened without difficulty because the laminating material of the lid on the membrane side and that of the membrane on the laminating side have no ability to adhere to each other, both preferably being made from paper on their surfaces facing each other.

At this stage, the opening function of the lid is therefore done, but this piece is not complete.

F. Finishing the Lid

FIGS. 6*a*-9 illustrate the finishing operations.

F1. Hemming

Figures 4A, 4B, 4C, 4D:
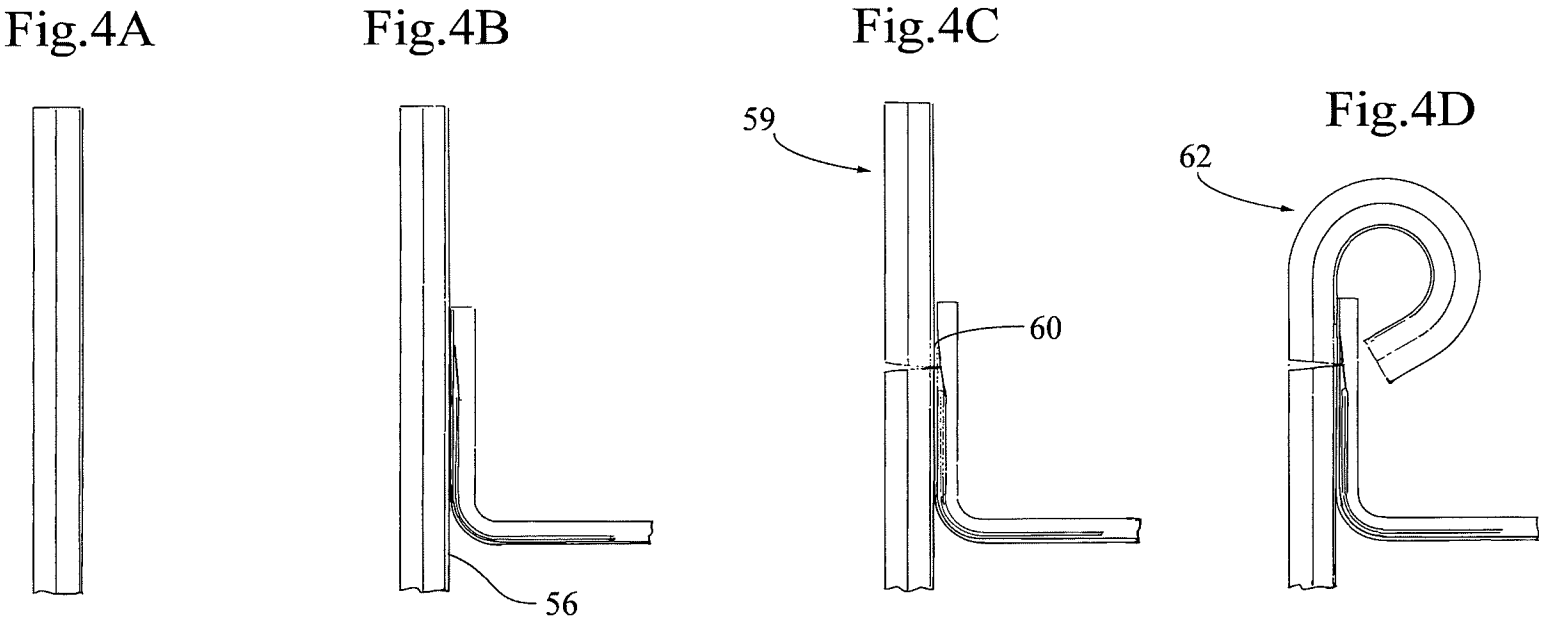
FIGS. 4*a*, 4*b*, 4*c* and 4*d* are partial enlarged views of the preceding figures showing the structural changes of the edges of the covering structure and the end of the tubular body, during the four assembly phases described above.

In patent no. 94 02003, the lid is finished in the hemming tool by a round hem (62) as shown in FIG. 4D, the purpose of which is to make it stronger and offer solid engagement for opening by breaking the three fastening points.

The round hem does not make it possible to stack the boxes at the point of sale. For that, it is necessary to perform additional operations to create the stacking function.

F2. Stacking the Lid

The first hem of the lid, in this case the round hem (80) of the lid shown in FIG. 6*a*, is worked to obtain a flat profile or a flat profile plus a centering profile corresponding to the inner profile of the box stacked on the lid.

1st Operation: Pre-Stacking Profile (81), FIG. 6*b:*

The lid, with its round hem, is introduced into a static tool made up of a die with a fixed outer shape and an expander tool made up of a crown on which a series of profiles is mounted in springs and actuated by a cone performing the following functions:

1) The die descends on the hem of the lid,

2) Pressure is applied on the hem of the lid to lower the hem toward the inside, 3) The expansion cone expands the profiles at Ø inside the lid via the actuator, 4) The actuator pulls the profiles upward and creates the flat shape necessary for the following operation, 5) The sequence ends by lowering and closing clamps at a Ø lower than that of the obtained flat profile, and the die can then be removed.

$2^{nd}$ Operation: Stacking Profile (82), FIG. 6*c:*

The lid, with its flat profiled hem, is introduced into a tool equipped with a die provided with the female stacking profile. A roller provided with the male stacking profile performs the final phase of the process as follows:

1) The die descends on the flat hem of the lid,

2) Vertical pressure is applied on the hem to keep the latter on the upper edge of the "lid cardboard" collar, 3) The profiler roller is transferred on the flat hem, 4) The profiler roller rotates at a good speed and simultaneously rises up to its stop to finish the stacking profile (82), 5) The sequence ends by lowering and removing the profiler roller, and the die can then be removed, The lid is finished, and the box is removed from the machine, verified and palletized.

The boxes are subsequently transported to the manufacturer of the concerned product, where they will be filled and closed by a bottom, then transported to the point of sale and sold to the consumer.

G. Examples of Stacking Profiles

The filled boxes are closed by various bottoms made from cardboard or metal; in the majority of the cardboard bottoms, each type of bottom has a different profile, resulting in the need to adapt the stacking profile for good maintenance of the stacking.

Three examples are provided in FIGS. 7, 8 and 9, illustrating the corresponding stacking profiles: the upper parts of the three figures diagrammatically show three different types of bottoms of box bodies, and the lower parts of the figures show the female stacking profiles of the lids of the boxes situated below.

Flat Stacking (82):

This profile makes it possible to stack all of the cardboard or metal bottom profiles without, however, allowing centering between the bottom and the lid.

Stacking (84) for Boxes with a Hemmed Cardboard Bottom (83):

The profile (84) is adapted to the thickness of the smoothed hem (83) according to the final thickness of the three thicknesses. This profile is not adapted to crimped metal bottoms.

Stacking (87) for Direct Cardboard Bottom (85, 86) and Metal Bottom:

The profile (87) is adapted to the thickness of the direct cardboard bottom (85, 86) placed and sealed without any hem. This profile is perfectly suitable for a crimped metal bottom (not shown in the figure).

One skilled in the art will note that the method for forming a stacking profile described above may be applied to tubular packages other than those made in the context of the present invention, on the condition that the edge of the lid has a profile that is or can be hemmed. It is for example applied to the packages described in French patent no. 94 02003.

H. Particular Embodiment of a Safety Membrane Tongue

Opening of the membrane: To remove the safety membrane, the consumer must pull on the tongue (73) of the membrane at an angle comprised between 30° and 60° relative to the vertical. This action creates a strong tension on the sealing materials of the membrane and the box body, and thereby on the cardboard layers of the box body. The most fragile cardboards layers frequently separate by delamination of the cardboard. During the development of the manufacturing method according to the invention, it has been observed that the wider the tongue is, the more difficult it is to perform an "easy opening." The shape of the tongue has therefore been studied and optimized, which has made it possible to minimize the above problem, to ensure delamination of the sealing layers without major effort and without altering the cardboard layers.

The new shape of the tongue is described in FIGS. 10 to 12.

Its shape resembles a balloon or a hot air balloon with its nacelle. The distal end is round; on the proximal side, it ends with a very narrow neck at the seal. Those skilled in the art will understand that the problem is resolved by the "hot air balloon" shape because the delamination force to the $cm^2$ is identical over the entire sealed surface, but the force to be applied for opening is directly proportional to the sealing surface of the tongue.

More particularly, the shape of the tongue is optimized so as to obtain:

1) Good gripping by the consumer:

The Ø of the distal end is comprised between 10 to 14 mm, in the case of a vertical seal, with a pulling angle varying from 30° to 60°: The length of the tongue is comprised between 22 and 30 mm.

2) A delaminating area of the average membrane material without altering the sealing of the membrane: The width of the tongue-membrane connecting neck is comprised between 4 and 6 mm. Two curve radii of 1 mm form the junction and make it possible not to create a rupture that would be risked if the junction were at a right angle.

FIG. 11 illustrates the position of the cutout on the tongue relative to:

the circle C1 for cutting out the covering structure from the assembled strip, the circle C2 for precutting the lid after assembling the covering structure with the tubular body, the circle C3 corresponding to the interlocking of the covering structure in the tubular body;

FIG. 11 illustrates this position of the cutout in the tongue in two situations of the tongue, i.e. from right to left:

1) in the right half of the FIG. 11*a* illustrates the pre-cut, but not folded tongue;

2) in the left half of the FIG. 11*a* illustrates the tongue folded at 180° and 11*b* represents the empty space left on the membrane material by the precut.

One skilled in the art will note that the shape of the tongue described above may be applied to other tubular packages provided with a safety membrane other than those made in the context of the present invention. It may for example be applied to the packages described in French patent 94 02003.

What is claimed is:

1. A method for manufacturing a covering structure of a cardboard package, said cardboard package comprising a tubular body made up of one or more layers of a cardboard material and a covering structure sealably assembled to an opening end of the tubular body, said covering structure comprising a lid cardboard, a laminating part and a safety membrane, said method comprising a step of forming a flat assembly of three materials, wherein each of said three materials is provided in a form selected from a group consisting of sheets and strips, i.e.:

a cellulosic material covered with at least one reactivatable barrier material over a face thereof oriented towards said safety membrane, making up said lid cardboard, a laminating material made from a material selected from a group consisting of paper and coated paper whereof a face oriented towards said lid cardboard is coated with a material having barrier and sealing properties relative to said lid cardboard, wherein said laminating material is cut to at least one laminating part having a shape conjugated to the shape of the opening end of the tubular body, and a material forming said safety membrane, made up of a paper that is coated with at least one reactivatable barrier material on the surface thereof not oriented towards said laminating part;

wherein said laminating part is arranged between said lid cardboard and said safety membrane in such a way to prevent sealing between the lid cardboard covered with the barrier material and the safety membrane; and wherein the laminating part is sealed on said lid cardboard over the surface thereof, with the exception of a marginal area extending over the entire circumference of said laminating part.

2. The manufacturing method according to claim 1, wherein the material making up said safety membrane undergoes pre-cutting generating a tongue, said tongue is folded down on the safety membrane across from the laminating part before being assembled with the other materials, and the material forming the safety membrane is partially sealed on the marginal area of the lid cardboard situated between the edge of the laminating part and the edge of said covering structure.

3. The method according to claim 2, wherein the reactivatable barrier material of the lid cardboard is replaced by a glue selected from the group consisting of cold and hot glues, the laminating part is completely glued by said glue, and the perimeter of the membrane is glued on the lid cardboard by cold, respectively hot gluing with the exception of the sector where the opening tongue is positioned, to allow discharged air to pass.

4. The manufacturing method according to claim 1, wherein the assembly formed by the three assembled materials undergoes cutting producing said covering structure in the form of a flat portion comprising a central part with a shape conjugated with the shape of the opening of the tubular body, surrounded by a peripheral portion that can be folded down that is sufficient to sealably assemble the covering structure with an inner lateral wall portion of the tubular body.

5. The manufacturing method according to claim 1, wherein said three materials are provided in the form of sheets.

6. The manufacturing method according to claim 2, continuous and paced step by step, wherein the three materials making up said flat assembly are provided in the form of strips of materials, wherein the strip intended to make up said laminating parts periodically comes across from the strip intended to make up said lid cardboard and undergoes cutting forming a laminating part each time, which is sealed or glued on the strip intended to make up said lid cardboards, wherein the strip intended to form the safety membrane undergoes said precutting and folding down operations of the tongue according to the pacing of the method, then is assembled strip by strip with the strip designed to form the lid cardboards, while being partially sealed or glued only on the lid cardboard surface portions situated between the laminating parts and the perimeters of said covering structures.

7. The manufacturing method according to claim 6, wherein the strip intended to form the laminating parts crosses the strip intended to form said lid cardboards at a cutting and placement tool, wherein said tool cuts a laminating part in the shape of the opening of the tubular body upon each step, then presses said laminating part against the strip designed to form said lid cardboards while heating the contact area to reactivate the barrier materials therein and perform pre-sealing, and wherein a sealing tool, arranged downstream of said cutting and placement tool, finishes completely sealing the laminating part with the exception of the marginal area extending over the entire circumference of the laminating part.

8. The manufacturing method according to claim 6, wherein the strip designed to form the safety membrane successively passes through a tongue cutting tool, a tool lifting and folding down said tongue, and a hammer performing the final folding of the tongue oriented toward the center of the flat portions.

9. The manufacturing method according to claim 6, wherein the strip obtained by assembling the three materials in a strip is further cut according to claim 5 into individual flat portions forming the covering structures.

10. A method for manufacturing a cardboard package comprising a tubular body made from one or more layers of a cardboard material and a lid sealably assembled to the tubular body, this method comprising:

producing a covering structure according to claim 4, introducing said covering structure into a forming, placement and sealing tool, heating said covering structure and shaping it in the form of a basin, introducing and sealing the basin in the tubular body using the forming, placement and sealing tool, precutting the lateral wall of the tubular body and the membrane along a peripheral line situated above said tongue.

11. The method for manufacturing a cardboard package according to claim 10, wherein the end of the tubular body that receives said covering structure undergoes finishing comprising a folding down over its entire circumference using a hemming tool forming a first hem, applying vertical and lateral pressure to convert said first hem into a flat profile hem, and creating a female stacking profile in said flat profiled hem using a roller tool chosen according to the male stacking profile of the box bottom designed to be stacked on said cardboard package.

12. A support strip for covering structures of a cardboard package, said cardboard package comprising a tubular body made up of one or more layers of a cardboard material and a covering structure, said covering structure comprising a lid cardboard, a laminating part and a safety membrane, said support strip comprising a flat assembly of three materials, i.e.:

a strip of cellulosic material covered with at least one reactivatable barrier material over a face thereof oriented towards said safety membrane, making up said lid cardboard, a plurality of laminating parts made from a material selected from a group consisting of paper and coated paper whereof a face oriented towards said lid cardboard is coated with a material having barrier and sealing properties relative to said lid cardboard, wherein said laminating material is cut to laminating parts having a shape conjugated to the shape of the opening end of the tubular body, wherein said laminating parts are arranged between said lid cardboard strip and a strip of material forming said safety membrane, and a strip of material forming said safety membrane, made up of a paper that is coated with at least one reactivatable barrier material on the surface thereof not oriented towards said laminating part, wherein said laminating part is arranged between said lid cardboard and said safety membrane in such a way to prevent sealing between the lid cardboard covered with the barrier material and the safety membrane; and wherein the strip forming the safety membrane has undergone a precutting and folding down operations of a tongue, is assembled strip by strip with the strip designed to form the lid cardboards, while being partially sealed or glued only on the lid cardboard surface portions situated between the laminating parts and the perimeters of said covering structures.

13. A covering structure of a cardboard package, said cardboard package comprising a tubular body made up of one or more layers of a cardboard material and a covering structure, said covering structure comprising a lid cardboard, a laminating part and a safety membrane, said covering structure being in the form of a flat portion comprising a flat assembly of three materials, i.e.:

a cellulosic material covered with at least one reactivatable barrier material over a face thereof oriented towards said safety membrane, making up said lid cardboard, a laminating part made from a material selected from a group consisting of paper and coated paper whereof a face oriented towards said lid cardboard is coated with a material having barrier and sealing properties relative to said lid cardboard, wherein said laminating material is cut to a shape conjugated to the shape of the opening end of the tubular body, wherein said laminating part is arranged between said lid cardboard strip and a material forming said safety membrane, and a material forming said safety membrane, made up of a paper that is coated with at least one reactivatable barrier material on the surface thereof not oriented towards said laminating part, wherein said laminating part is arranged between said lid cardboard and said safety membrane in such a way to prevent sealing between the lid cardboard covered with the barrier material and the safety membrane; and wherein the safety membrane has undergone a precutting and folding down operations of a tongue, and is partially sealed or glued only on the lid cardboard surface portions situated between the laminating parts and the perimeters of said covering structures.

14. A covering structure according to claim 13, wherein the tongue has a distal wide end to ensure easy gripping by a consumer, a narrow portion, forming a connecting neck, near its proximal end of the sealed portion of said safety membrane, and a rounded portion between the neck and the sealed portion of the safety membrane.

15. The covering structure according to claim 14, wherein said distal end has a substantially circular shape whereof the diameter is comprised between 10 and 14 mm, the length of the tongue is comprised between 22 and 30 mm, and the width of the connecting neck is comprised between 4 and 6 mm.

16. A cardboard package comprising a tubular body made up of one or more layers of a cardboard material and a covering structure, according to claim 13.

17. The cardboard package comprising a tubular body made up of one or more layers of a cardboard material and a covering structure according to claim 14.

* * * * *